US007482758B2

(12) United States Patent
Hua et al.

(10) Patent No.: US 7,482,758 B2
(45) Date of Patent: Jan. 27, 2009

(54) MAGNETIC LOW VOLTAGE DIMMER

(75) Inventors: Jenkin P. Hua, Plainsboro, NJ (US); Michael Ostrovsky, Brooklyn, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 370 days.

(21) Appl. No.: 11/367,985

(22) Filed: Mar. 3, 2006

(65) Prior Publication Data

US 2006/0208662 A1 Sep. 21, 2006

Related U.S. Application Data

(60) Provisional application No. 60/658,080, filed on Mar. 3, 2005.

(51) Int. Cl.
*H05B 37/00* (2006.01)

(52) U.S. Cl. ..... 315/119; 315/225; 315/DIG. 4

(58) Field of Classification Search ..... 315/119, 315/125, 126, 127, 128, 88, 224, 225, 226, 315/DIG. 4, DIG. 5

See application file for complete search history.

(56) References Cited

U.S. PATENT DOCUMENTS 3,873,882 A 3/1975 Gershen
4,396,869 A 8/1983 Rosenbaum et al.
4,876,498 A 10/1989 Luchaco et al.
4,954,768 A 9/1990 Luchaco et al.
5,336,979 A 8/1994 Watson et al.
5,383,084 A 1/1995 Gershen et al.
5,485,058 A 1/1996 Watson et al.
5,499,155 A 3/1996 Gershen et al.
5,621,283 A 4/1997 Watson et al.
5,684,376 A 11/1997 Neiger et al.
5,729,421 A 3/1998 Gershen et al.
5,789,894 A 8/1998 Neiger et al.
6,380,692 B1 * 4/2002 Newman et al. ..... 315/194
6,486,616 B1 * 11/2002 Liu et al. ..... 315/291
7,242,563 B2 7/2007 Hua

* cited by examiner

*Primary Examiner*—David Hung Vu
(74) *Attorney, Agent, or Firm*—Weiss & Arons, LLP

(57) ABSTRACT

The present invention provides a magnetic low voltage dimmer circuit that reduces DC magnetizing current which may be present in a dimmer system. The dimmer circuit delivers an RMS value of an AC supply voltage to a load while preventing or reducing a DC magnetizing current from damaging the dimmer circuit and/or load. The dimmer circuit includes a shutdown circuit which detects whether a DC voltage, corresponding to the DC current, is present across a circuit component and whether the DC voltage has reached or exceeded a predetermined voltage reference level, rendering the component non-conductive and thus preventing the DC magnetizing current from flowing through a load.

15 Claims, 4 Drawing Sheets

MAGNETIC LOW VOLTAGE DIMMER

CROSS-REFERENCE TO RELATED APPLICATION

This application claims the benefit under 35 U.S.C. §119 (e) of U.S. Provisional Application No. 60/658,080, filed on Mar. 3, 2005.

FIELD OF THE INVENTION

The present invention pertains generally to a two wire magnetic low voltage dimmer.

BACKGROUND OF THE INVENTION

FIG. 1 is a block diagram of a conventional two wire low voltage dimming system 10. Dimming system 10 comprises a two wire dimming circuit 24 with a pair of wires 26, 16 connected in series with the primary 18 of a transformer 21 and an alternating current (AC) supply voltage 12. Dimming circuit 24 comprises a Triac 22 having a control circuit 28 operatively coupled across the circuit 24 for supplying control signals to the gate terminal 23 of the Triac 22 for selectively rendering the Triac 22 conductive. The timing of the control signals and hence the firing angle of the Triac 22 governs the root mean square (RMS) value of the AC voltage applied to the load. The dimmer circuit 24 illustrated in FIG. 1 is shown as controlling the low voltage applied to a lamp 14 connected across secondary 20.

The firing angle of Triac 22 is governed by the instantaneous voltage across the control circuit 28, and hence across wires 26, 16. Thus, the firing angle may be affected by the phase shift caused by magnetic load, which may cause an asymmetric firing at different half cycles of the AC voltage, resulting in a direct current (DC) component that flows through the primary 18 of transformer 21. The magnitude of this DC current may become significant and cause saturation of the magnetic material in the core of the transformers and a significant increase in current capable of damaging both the transformer and the dimmer. The asymmetric firing of the Triac is due to an increased phase shift between voltage and current, which may create a condition in which the Triac cannot begin to conduct and latch its state. This is especially a problem in dimmers using short gate pulses to fire a Triac, because a 2-wire power supply cannot provide sufficient current to keep the gate of the Triac at the correct level throughout the required Triac conduction time. A large phase shift may occur, for example, if one or more of the lamps 14 burns out.

What is needed is a magnetic low voltage dimmer that reduces the DC magnetizing current that may be present in a dimmer system, and thus protects the load and dimmer from damage.

SUMMARY OF THE INVENTION

The present invention provides a magnetic low voltage dimmer circuit that reduces DC magnetizing current which may be present in a dimmer system. The dimmer circuit delivers an RMS value of an AC supply voltage to a load while preventing or reducing a DC magnetizing current from damaging the dimmer circuit and/or load.

The dimmer circuit includes a control circuit operatively coupled to a circuit component for providing a control signal thereto; the circuit component is configured to pass current in accordance with the control signal. The shutdown circuit is operatively coupled to the control circuit and monitors DC voltage fluctuations across the circuit component. The shutdown circuit causes the component to become non-conductive in accordance with a comparison of the DC voltage fluctuations with a predetermined voltage level.

In an embodiment of the invention, the dimmer circuit includes a pair of wires for connection in series with a load and an AC supply voltage, a Triac, a control circuit and a shutdown circuit. The Triac has a gate terminal and first and second main terminals where the first main terminal is operatively coupled to one of the pair of wires, and the second main terminal is operatively coupled to the other of the pair of wires. The control circuit is coupled to the gate terminal of the Triac and selectively fires and renders the Triac conductive. The shutdown circuit detects whether a DC voltage, corresponding to the DC current, is present across the Triac and whether the DC voltage has reached or exceeded a predetermined voltage reference level, rendering the Triac non-conductive and thus preventing the DC magnetizing current from flowing through a load.

The shutdown circuit may be coupled across the Triac and monitors DC voltage fluctuations across the Triac, and renders the Triac non-conductive when the DC voltage fluctuations reach or exceed a predetermined voltage reference level. The shutdown circuit may maintain the Triac in the non-conductive or latched state until the AC supply voltage is removed or the circuit is reset.

The foregoing has outlined some features of the present invention so that those skilled in the art may better understand the detailed description of the invention that follows. Additional features of the invention will be described hereinafter that form the subject of the claims of the invention. Those skilled in the art will appreciate that they can readily use the disclosed embodiments as a basis for the designing or modifying other structures for carrying out the same purposes of the present invention and that such other.

BRIEF DESCRIPTION OF THE DRAWINGS

Other aspects, features and advantages of the present invention will become more fully apparent from the following detailed description, the appended claim, and the accompanying drawings in which similar elements are given similar reference numerals:

DETAILED DESCRIPTION

The present invention provides a magnetic low voltage dimmer circuit that reduces DC magnetizing current that may be present in a dimmer system. The dimmer circuit delivers an RMS value of an AC supply voltage to a load while preventing the DC magnetizing current from damaging the dimmer circuit and/or load. The dimmer circuit includes a shutdown means which detects whether a DC voltage, corresponding to the DC magnetizing current, is present across a Triac and whether the DC voltage has reached or exceeded a predetermined voltage reference level, rendering the Triac non-conductive and thus preventing the DC magnetizing current from flowing through a load.

Figure 1:
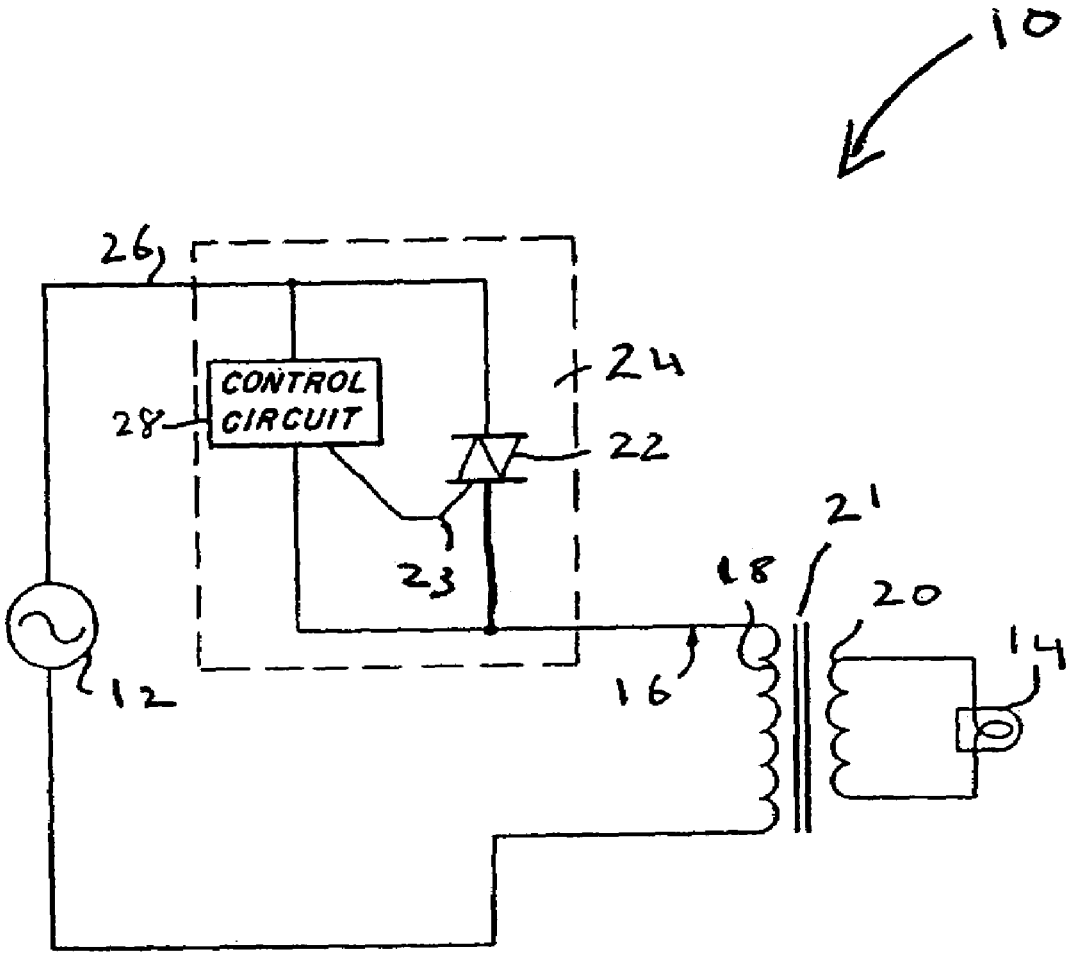
FIG. 1 PRIOR ART
FIG. 1 is a block diagram of a prior art magnetic low voltage dimming circuit.
Figure 2:
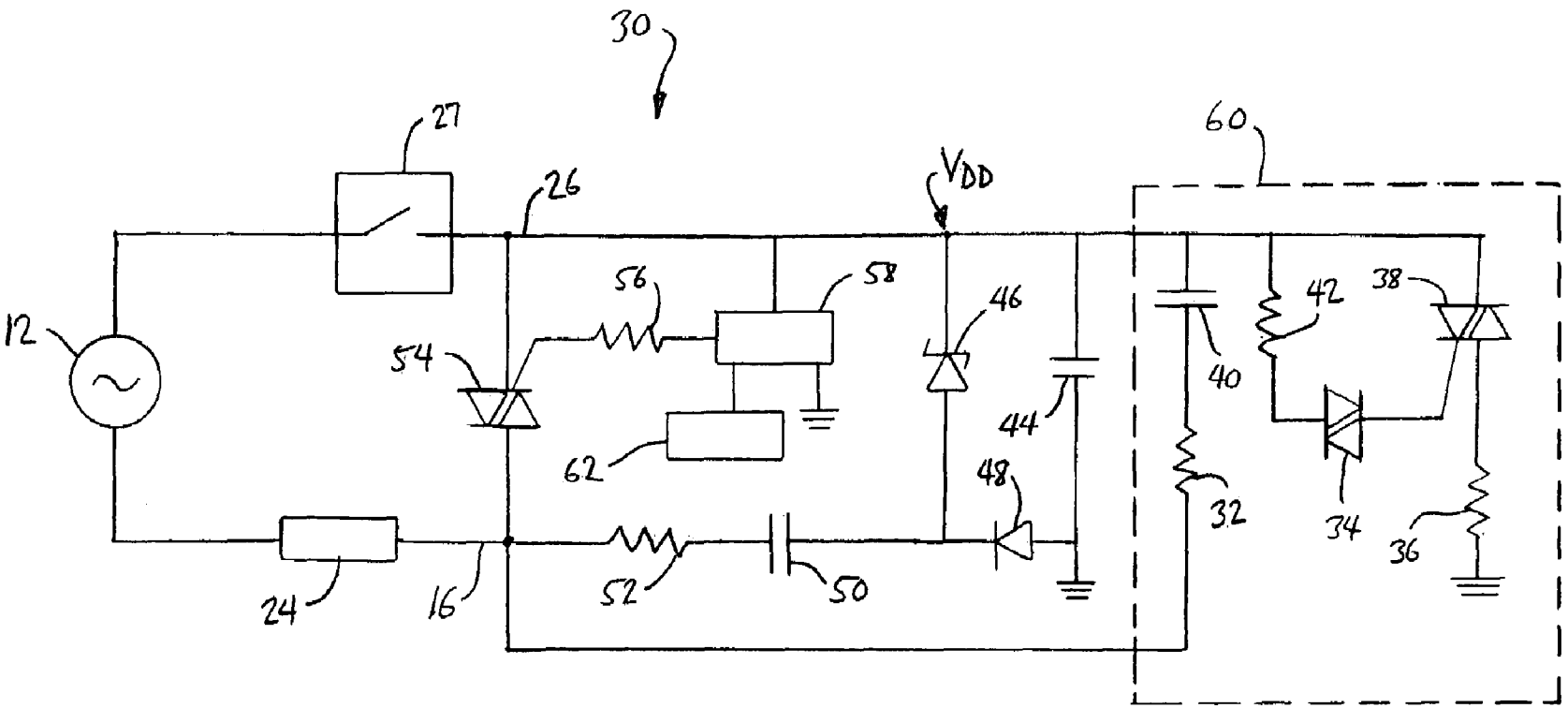
FIG. 2 is a schematic diagram of a magnetic low voltage dimmer circuit according to a first embodiment of the present invention.

Referring to FIG. 2, there is illustrated a schematic diagram of a two wire magnetic low voltage dimmer circuit 30 that reduces the DC magnetizing current in a dimmer system according to a first embodiment of the present invention. Dimmer circuit 30 includes a pair of wires 26, 16 connected in series with a load 24, a switch means 27 and an AC supply voltage 12. Load 24 can be resistive such as a lamp or reactive such as a low voltage transformer, a ballast, a fluorescent lighting system or a motor. Dimmer circuit 30 also includes a shutdown means 60 that monitors DC voltage fluctuations across Triac 54 (first Triac) and renders the Triac non-conductive when the DC voltage fluctuations reach or exceed a predetermined level. The DC voltage fluctuations are based on DC magnetizing currents caused by a load having both a resistive and an inductive component; both the DC voltages and DC currents are undesirable. Shutdown means 60 detects the presence of the DC magnetizing current and turns off the dimmer circuit, preventing the DC current from damaging the circuit and/or load. Shutdown means 60 as well as dimmer circuit 30 are described in detail below.

A control means 58 is operatively coupled to the gate of Triac 54 through Resistor 56. Triac 54 includes a first main terminal operatively coupled to wire 26, and a second main terminal operatively coupled to wire 16. Control means 58 generates control signals for selectively firing and rendering Triac 54 conductive. The timing of the control signals and hence the firing angle of Triac 54 governs the RMS value of the AC voltage applied to load 24. A voltage regulation means 46 (e.g., a Zener Diode) includes a first terminal (e.g., cathode) directly coupled to wire 26, and a second terminal (e.g., anode) coupled to wire 16 through Resistor 52 and Capacitor 50.

Voltage regulation means 46 provides a regulated DC voltage VDD (e.g., 5 volts DC) referenced to Ground. Capacitor 44 is coupled across wire 26 and Ground. Diode 48 is coupled between the Ground terminal and the cathode terminal of voltage regulation means 46 to reduce or prevent the DC magnetizing current from flowing between voltage regulation means 46 and Ground. Voltage detection means 62 is operatively coupled to voltage regulation means 46 and to control means 58 for detecting when the regulated DC voltage VDD has deviated from a predetermined value. Switch means 27 has a selectable ON position (provides an electrical path between AC supply 12 and load 24) and OFF position (disconnects the electrical path between AC supply 12 and load 24).

Shutdown means 60 includes a DC voltage sensing means that comprises Resistors 32 and 42 and Capacitor 40 operatively coupled across the first and second main terminals of Triac 54 (i.e., wire 26 and 16) for monitoring or sensing DC voltage fluctuations across Triac 54. A Diac 34 is coupled between a gate terminal of a Triac 38 (second Triac) and a junction of the DC voltage sensing means. Triac 38 includes a first main terminal operatively coupled to wire 26 and a second main terminal operatively coupled to the Ground terminal through Resistor 36.

In operation, when a DC magnetizing current flows through load 24 a corresponding DC voltage is developed across the voltage sensing means. That is, the DC current flow charges Capacitor 40 so that the DC voltage developed across the Capacitor 40 and Resistor 32 is substantially the same as the DC voltage across Triac 54. If the developed DC voltage across Resistor 32 is sufficient to overcome the breakdown voltage of Diac 34, then Diac 34 is rendered conductive. In turn, Triac 38 is rendered conductive if the voltage applied to the gate of Triac 38 is sufficient to fire the Triac. Once Triac 38 is conductive, the charge accumulated on Capacitor 40 is discharged through Triac 38 and Resistor 36 to the Ground terminal. The resistance value of Resistor 36 is small compared to the impedance of Capacitor 50, causing voltage VDD to be reduced since voltage regulation means 46 is unable to maintain regulated voltage VDD.

The reduction in voltage VDD is detected by voltage detection means 62 which generates a signal to control means 58 to render Triac 54 non-conductive. Once Triac 54 becomes non-conductive, Capacitor 40 discharges through Resistor 42. Once Triac 38 is rendered conductive, it remains in the conductive condition or latched state until dimmer circuit 30 is reset. For example, dimmer circuit 30 can be reset by placing switch means 27 in the OFF position (open) to disconnect AC power supply 12 from dimmer circuit 30. Thus, shutdown means 60 detects DC voltages across Triac 54, corresponding to DC magnetizing currents through load 24, and renders Triac 54 non-conductive which prevents the DC magnetizing currents from flowing through load 24.

Once dimmer circuit 30 has been reset and the DC magnetizing current flowing through load 24 has been reduced, dimmer circuit can resume normal operation. During normal operation, switch means 27 is placed in the ON position (closed) providing an electrical path between AC power supply 12 and load 24. Control means 58 resumes generating control signals to gate terminal of Triac 54 for selectively firing and rendering Triac 54 conductive so to deliver an RMS value of the AC supply to load 24. In addition, shutdown means 60 continues to monitor for undesirable DC voltages across Triac 54.

As explained above, shutdown means 60 renders Triac 54 non-conductive when the DC voltage fluctuations reach or exceed a predetermined voltage reference level. The predetermined voltage reference level is based on DC voltage VDD provided by voltage regulation means 46. In one embodiment, voltage regulation means 46 is a Zener Diode providing a DC voltage VDD of 8 volts (a predetermined voltage reference level) based on Zener characteristics including Zener voltage Vz of 8 volts, current Iz of 90 microamps and maximum current Izmax of 120 microamps. If the DC voltage fluctuation is expected to be equal to approximately 10 volts DC, then the value of Resistor 32 is selected as 58 kilohms and the value of Capacitor 40 is selected as 11 microfarads. In operation, shutdown means 60 detects the DC voltage fluctuations of 10 volts DC and determines that it exceeds the predetermined voltage reference level of 8 volts DC provided by the Zener Diode. As a result, shutdown means 60 renders Triac 54 non-conductive.

Figure 3:
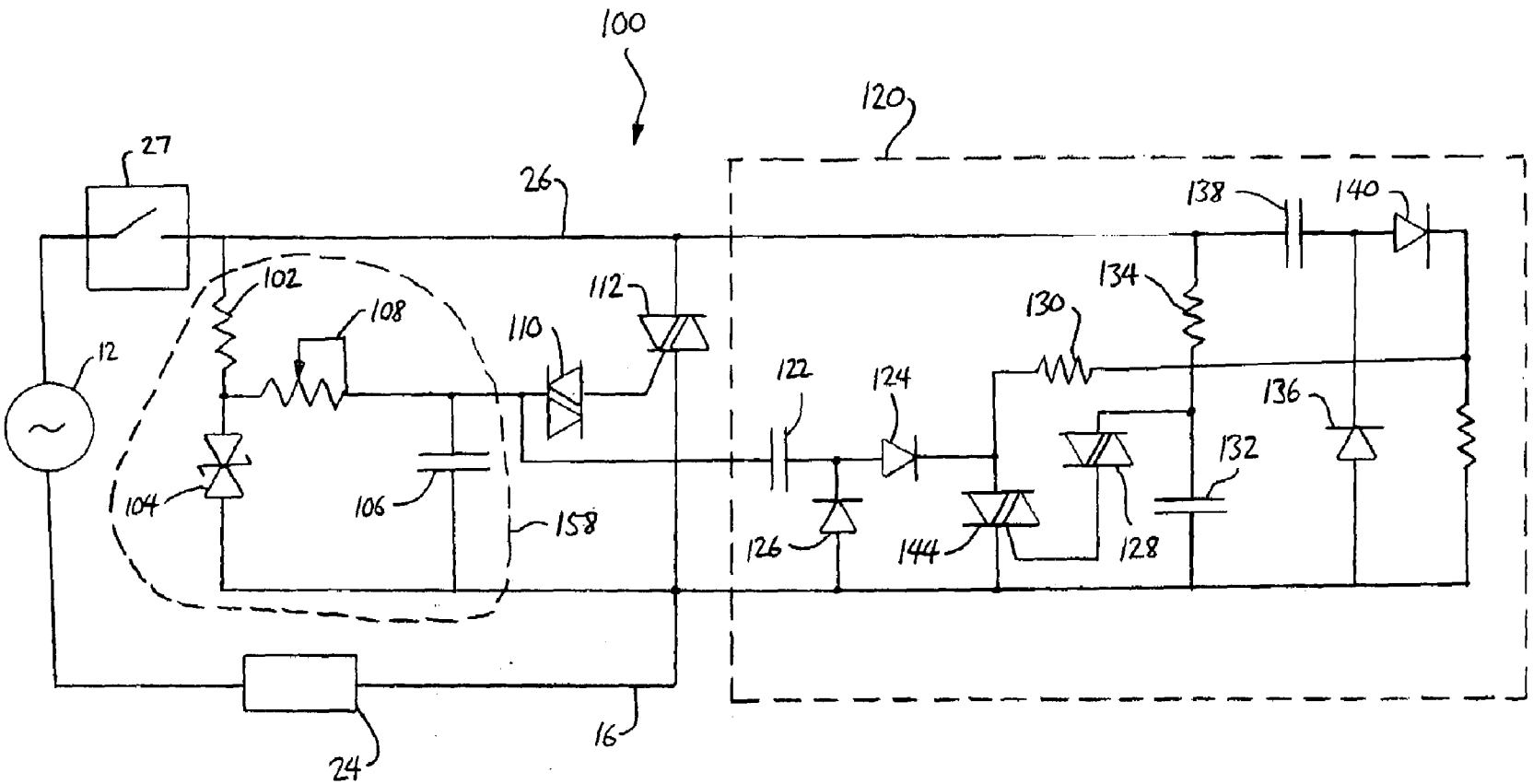
FIG. 3 is a schematic diagram of a magnetic low voltage dimmer circuit according to a second embodiment of the present invention.

FIG. 3 is a schematic diagram of a two wire low voltage dimmer circuit 100 according to a second embodiment of the present invention. As in the circuit of FIG. 2, dimmer circuit 100 includes a pair of wires 26, 16 connected in series with a load 24, a switch means 27 and an AC supply voltage 12. Dimmer circuit 100 also includes a shutdown means 120 that monitors DC voltage fluctuations across Triac 112 (first Triac) and renders the Triac non-conductive when the DC voltage fluctuations reach or exceed a predetermined voltage reference level.

Shutdown means 120 includes a DC voltage sensing means that comprises Resistors 130, 134, Capacitors 122, 132, 138 and 142 and Diodes 124, 126, 136 and 140 operatively coupled across the first and second main terminals of Triac 112 for monitoring or sensing DC voltage fluctuations across Triac 112. A Diac 128 is coupled between a gate terminal of a Triac 144 (second Triac) and a junction of the DC voltage sensing means. Triac 144 includes a first main terminal operatively coupled to wire 16 and a second main terminal operatively coupled to gate terminal of Triac 112 through Diac 110, Capacitor 122 and Diode 124.

Dimmer circuit 100 includes a control means 158 comprising Resistor 102, transient voltage suppression (TVS) device 104, potentiometer/trim circuit 108 and Capacitor 106. Control means 158 is operatively coupled to Triac 112 for generating control signals for selectively firing and rendering Triac 112 conductive. The timing of the control signals and hence the firing angle of Triac 112 governs the RMS value of the AC voltage applied to load 24.

The operation of dimmer circuit 100 is similar to the operation of dimmer circuit 30 in FIG. 2. For example, when a DC magnetizing current flows through load 24 a corresponding DC voltage is developed across the voltage sensing means. That is, the DC magnetizing current flow charges Capacitor 132 so that the DC voltage developed across Capacitor 132 and Resistor 134 is substantially the same as the DC voltage across Triac 112. If the developed DC voltage across Capacitor 132 is sufficient to overcome the breakdown voltage of Diac 128, then Diac 128 is rendered conductive. In turn, Triac 144 is rendered conductive if the voltage applied to the gate of Triac 144 is sufficient to fire the Triac. Once Triac 144 is conductive, it remains in the conductive condition or latched state until dimmer circuit 100 is reset as previously explained. Triac 144 generates a control signal to the gate of Triac 112 to render Triac 112 non-conductive.

Once dimmer circuit 100 has been reset and there is no longer a DC magnetizing current flowing through load 24, dimmer circuit 100 can resume normal operation as explained above. For example, the control means generates control signals to the gate terminal of Triac 112 for selectively rendering Triac 112 conductive. In addition, shutdown circuit 120 continues to monitor for undesirable DC voltages (caused by DC magnetizing currents through load 24) across Triac 112.

Figure 4:
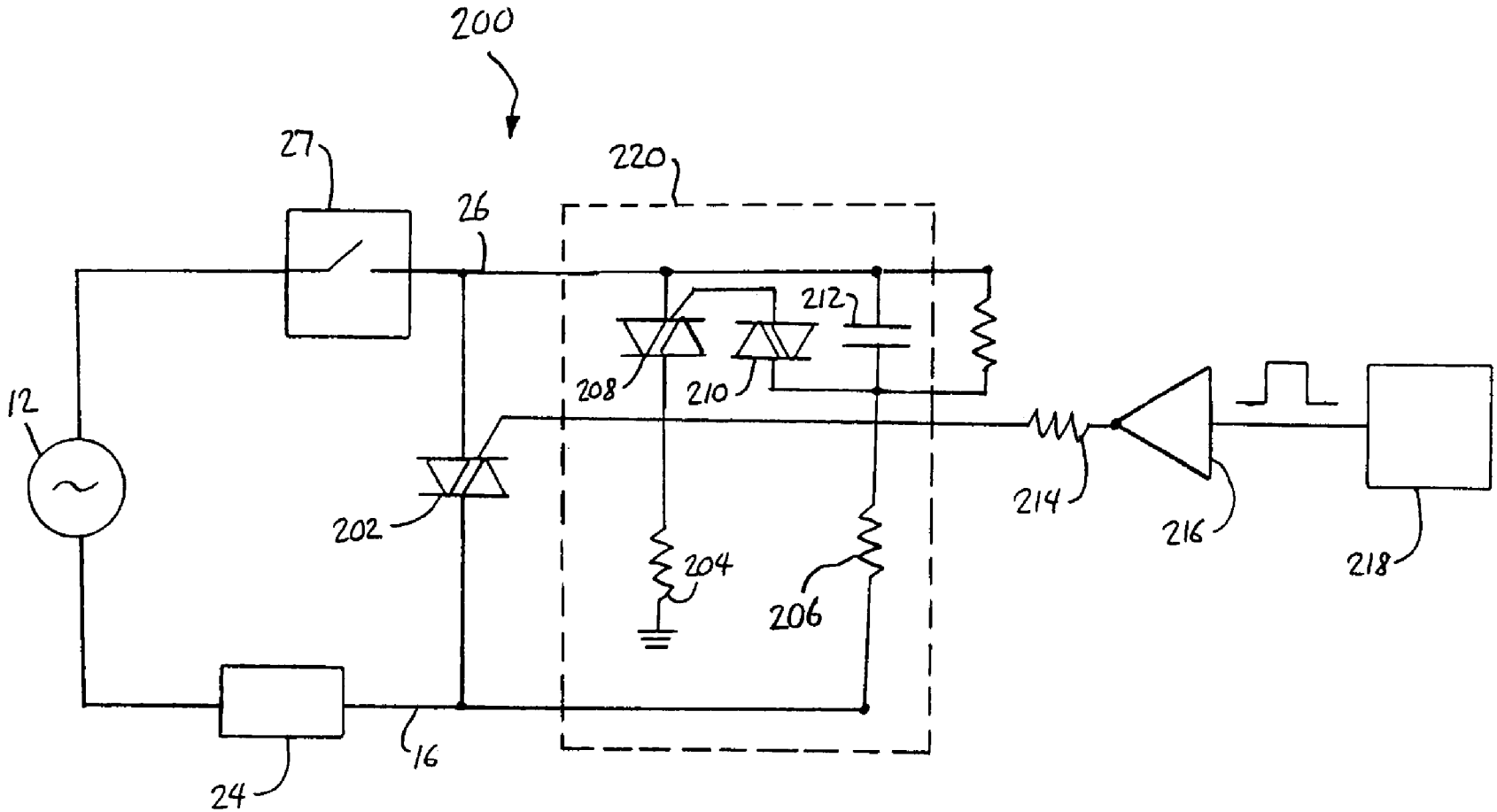
FIG. 4 is a schematic diagram of a magnetic low voltage dimmer circuit according to a third embodiment of the present invention.

FIG. 4 is a schematic diagram of a two wire low voltage dimmer circuit 200 according to a third embodiment of the present invention. As in the circuit of FIG. 3, dimmer circuit 200 includes a pair of wires 26, 16 connected in series with a load 24, a switch means 27 and an AC supply voltage 12. Dimmer circuit 200 also includes a shutdown means 220 that monitors DC voltage fluctuations across Triac 202 and renders the Triac non-conductive when the DC voltage fluctuations reach or exceed a predetermined voltage reference level.

Shutdown means 220 includes a DC voltage sensing means that comprises Resistors 206, 204 and Capacitor 212 operatively coupled across the first and second main terminals of Triac 202 for monitoring or sensing DC voltage fluctuations across Triac 202. A Diac 210 is coupled between a gate terminal of a Triac 208 and a junction of the DC voltage sensing means. Triac 208 includes a first main terminal operatively coupled to wire 26 and a second main terminal operatively coupled to the Ground terminal through Resistor 204.

Dimmer circuit 200 includes a control means comprising a controller 218 coupled to a gate of Triac 202 through digital buffer 216 and Resistor 214. Controller 218 is configured to generate control signals to the gate of Triac 202 to selectively fire and render Triac 202 conductive. As explained above, the timing of the control signals and hence the firing angle of Triac 202 governs the RMS value of the AC voltage applied to load 24.

The operation of dimmer circuit 200 is similar to the operation of dimmer circuit 30 in FIG. 2 and dimmer circuit 100 in FIG. 3. For example, when a DC magnetizing current flows through load 24 a corresponding DC voltage is developed across voltage sensing means. In other words, the DC current flow charges Capacitor 212 so that the DC voltage developed across the Capacitor 212 and Resistor 206 is substantially the same as the DC voltage across Triac 202. If the DC voltage across Resistor 206 is sufficient to overcome the breakdown voltage of Diac 210, then Diac 210 is rendered conductive. In turn, Triac 208 is rendered conductive if the voltage applied to the gate of Triac 208 is sufficient to fire the Triac. Once Triac 208 is rendered conductive, it remains in the conductive condition or latched state until a reset event occurs as explained above. The conduction of Triac 208 is detected by controller 218 which generates a signal to Triac 202 to render Triac 202 non-conductive. Thus, the dimmer circuit 200 detects DC voltages across Triac 202, corresponding to DC currents through load 24, and renders Triac 202 non-conductive which reduces or prevents the DC magnetizing currents from flowing through load 24.

Once dimmer circuit 200 has been reset and there is no longer a DC magnetizing current flowing through load 24, the dimmer circuit can resume normal operation as explained above. For example, the controller 218 resumes generating control signals to the gate terminal of Triac 202 for selectively firing and rendering Triac 202 conductive. Moreover, shutdown circuit 220 continues to monitor for undesirable DC voltages across Triac 202 caused by DC magnetizing currents.

While there have been shown and described and pointed out the fundamental features of the invention as applied to the preferred embodiment, it will be understood that various omissions and substitutions and changes of the form and details of the device described and illustrated and in its operation may be made by those skilled in the art, without departing from the spirit of the invention.

The invention claimed is:

1. A dimmer circuit comprising:

a control circuit operatively coupled to a circuit component for providing a control signal thereto;

said circuit component, configured to pass current in accordance with the control signal;

a shutdown circuit, operatively coupled to said control circuit, for monitoring DC voltage fluctuations across said component, wherein said shutdown circuit is configured to cause said component to become non-conductive in accordance with a comparison of the DC voltage fluctuations with a predetermined voltage level.

2. The dimmer circuit of claim 1, wherein the shutdown circuit includes a voltage sensing circuit operatively coupled across terminals of said component, thereby sensing the DC voltage fluctuations.

3. The dimmer circuit of claim 1, further comprising a voltage regulator for providing a regulated voltage.

4. The dimmer circuit of claim 3, further comprising a voltage detection circuit for detecting a deviation of the regulated voltage from a predetermined value, thereby performing said comparison.

5. The dimmer circuit of claim 1, wherein said component is a Triac and the control circuit is connected to a gate terminal of the Triac for selectively causing the Triac to be in one of a conductive state and a non-conductive state.

6. The dimmer circuit of claim 1, wherein the control circuit further comprises a digital buffer.

7. The dimmer circuit of claim 1, wherein the control circuit includes a transient voltage suppression device.

8. The dimmer circuit of claim 5, wherein the Triac is characterized as a first Triac, and the shutdown circuit includes a second Triac having a main terminal operatively coupled to the gate terminal of the first Triac.

9. The dimmer circuit of claim 5, wherein the control circuit includes a controller and a digital buffer operatively coupled to the gate terminal of the Triac.

10. The dimmer circuit of claim 9, wherein the Triac is characterized as a first Triac, the shutdown circuit includes a second Triac, and the controller is configured to detect a conductive state of the second Triac and to generate a signal to cause the first Triac to become non-conductive in accordance with the second Triac being conductive.

11. The dimmer circuit of claim 1, wherein the circuit is effective to reduce DC magnetizing current in a load connected to the circuit.

12. The dimmer circuit of claim 11, further comprising a first wire for connecting to an AC supply voltage; and a second wire for connecting to the load, wherein the component has a gate terminal, a first main terminal and a second main terminal, the first main terminal and the second main terminal operatively coupled to the first wire and the second wire respectively.

13. The dimmer circuit of claim 12, wherein said component is a Triac, the control circuit is connected to the gate terminal thereof for selectively causing the Triac to be in one of a conductive state and a non-conductive state, and the control signal is effective to determine an RMS value of the AC supply voltage applied to the load.

14. The dimmer circuit of claim 13, wherein the Triac is characterized by a firing angle determined by a timing of the control signal.

15. The dimmer circuit of claim 12, further comprising a switch connected to the first wire, so that opening the switch is effective to disconnect the AC power supply from the dimmer circuit.

* * * * *